US009142929B2

(12) United States Patent
Nagasawa

(10) Patent No.: US 9,142,929 B2
(45) Date of Patent: Sep. 22, 2015

(54) SOCKET

(71) Applicant: Yazaki Corporation, Tokyo (JP)

(72) Inventor: Masanori Nagasawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/174,451

(22) Filed: Feb. 6, 2014

(65) Prior Publication Data

US 2014/0154932 A1 Jun. 5, 2014

Related U.S. Application Data

(63) Continuation of application No. PCT/JP2012/070871, filed on Aug. 10, 2012.

(30) Foreign Application Priority Data

Aug. 10, 2011 (JP) ..... 2011-174846

(51) Int. Cl.
*H01R 33/06* (2006.01)
*H01R 33/09* (2006.01)
*H01R 33/97* (2006.01)

(52) U.S. Cl.
CPC ..... *H01R 33/09* (2013.01); *H01R 33/97* (2013.01)

(58) Field of Classification Search
CPC ..... H01R 33/09; H01R 33/06; H01K 1/46
See application file for complete search history.

(56) References Cited

U.S. PATENT DOCUMENTS 4,157,463 A * 6/1979 Fujita ..... 200/307
4,630,880 A * 12/1986 Durand ..... 439/595
4,720,272 A * 1/1988 Durand ..... 439/375
5,035,643 A * 7/1991 Forish et al. ..... 439/358
5,634,823 A * 6/1997 Furuta et al. ..... 439/699.2
5,865,647 A * 2/1999 Garber et al. ..... 439/611
5,895,295 A 4/1999 Harada
5,971,814 A * 10/1999 Boyd et al. ..... 439/699.2
6,250,970 B1 * 6/2001 Key et al. ..... 439/699.2
8,047,700 B2 * 11/2011 Massabki et al. ..... 362/654
2004/0165411 A1 8/2004 Heath et al.
2006/0175186 A1 8/2006 Fuji

FOREIGN PATENT DOCUMENTS

EP 1 128 495 A2 8/2011
JP 2906981 B2 4/1999
JP 2001-273959 A 10/2001
JP 2006221845 A 8/2006
JP 20075103 A 1/2007

OTHER PUBLICATIONS

International Search Report dated Nov. 28, 2012 issued in International Application No. PCT/JP2012/070871 (PCT/ISA/210).
Written Opinion dated Nov. 28, 2012 issued in International Application No. PCT/JP2012/070871 (PCT/ISA/237).
Office Action dated Mar. 24, 2015, issued by the Japanese Intellectual Property Office in counterpart Japanese Application No. 2011-174846.
Office Action, dated Jun. 19, 2015, issued by The State Intellectual Property Office in counterpart Chinese Patent Application No. 201280039053.3.

* cited by examiner

*Primary Examiner* — Gary Paumen
(74) *Attorney, Agent, or Firm* — Sughrue Mion, PLLC

(57) ABSTRACT

A socket includes a tubular frame body into which a base part of an electric lamp bulb is to be inserted, the frame body in which a terminal metal fitting to be electrically connected with the base part is to be provided, the frame body having a side wall formed with two slits and formed with an arm piece between the slits, the arm piece which has a first face to be opposed to the terminal metal fitting and a second face opposite to the first face, the side wall formed with a butting face, when the arm piece is deformed outward of the frame body, a part of the second face of the arm piece is in contact with the butting face.

5 Claims, 4 Drawing Sheets

SOCKET

CROSS REFERENCE TO RELATED APPLICATIONS

This application is a continuation of PCT application No. PCT/JP2012/070871, which was filed on Aug. 10, 2012 based on Japanese Patent Application (No. 2011-174846) filed on Aug. 10, 2011, the contents of which are incorporated herein by reference.

BACKGROUND OF THE INVENTION

1. Field of the Invention

The present invention relates to a socket for holding a base part of an electric lamp bulb.

2. Description of the Related Art

For example, PTL 1 discloses a structure of a socket having a frame body in a tubular shape into which a base part of an electric lamp bulb is inserted. In the frame body of this socket, a pair of terminal metal fittings which are electrically connected to the bulb, while clamping the base part of the bulb with pressure. The frame body of the socket is formed in a rectangular shape in conformity with the base part of the bulb. A pair of opposed side walls of this frame body are respectively provided with two slits extending from open ends of the side walls along an axial direction of the frame body. An arm piece for elastically supporting each of the terminal metal fittings is formed between these two slits. The terminal metal fitting has a folded part which is projected in a V-shape into the frame body.

In the above described structure, when the base part of the bulb is inserted into the frame body, convex parts which are respectively formed on opposed faces of the base part come into contact with the folded parts of the terminal metal fittings thereby to deform the folded parts. By further deeply inserting the convex parts, the folded parts which have been deformed press the arm pieces, and are spread outward together with the arm pieces, thereby allowing the convex parts to override the folded parts. As the convex parts are pushed in, the base part of the bulb is pressed with the terminal metal fittings from both sides, and the folded parts are positioned behind the convex parts. In this manner, the bulb is retained inside the frame body. According to this structure, when the base part is inserted into the frame body, the arm pieces are spread along with deformation of the terminal metal fittings. As the results, it is possible to prevent excessive deformation of the terminal metal fittings, and also to restrain permanent deformation of the terminal metal fittings.

CITATION LIST

Patent Literature

[PTL 1] Japanese Patent No. 2906981

By the way, a tolerance range of a projecting amount of the convex parts which are provided on the base part of the bulb is set to be larger as compared with a tolerance in size of the socket, for example. Therefore, in case where the bulb is designed in such a manner that a holding force (resistivity in an withdrawing direction) of the base part may satisfy prescription when the projecting amount of the convex parts is at a lower limit value of the tolerance, there is such anxiety that by inserting the base part where the projecting amount of the convex parts is at an upper limit value of the tolerance, the terminal metal fittings may be largely spread outward together with the arm pieces, and consequently, permanent deformation of the terminal metal fittings may occur. Moreover, there is such anxiety that due to the permanent deformation of the terminal metal fittings, the holding force of the bulb may be decreased, and electrical contact performance of the bulb may be deteriorated.

SUMMARY OF THE INVENTION

The invention provides a socket operable to prevent excessive deformation of terminal metal fittings, when a base part of an electric lamp bulb is inserted into a frame body of a socket.

An aspect of the invention provides a socket comprising: a tubular frame body into which a base part of an electric lamp bulb is to be inserted, the frame body in which a terminal metal fitting to be electrically connected with the base part is to be provided, the frame body having a side wall formed with two slits and formed with an arm piece between the slits, the arm piece which has a first face to be opposed to the terminal metal fitting and a second face opposite to the first face, the side wall formed with a butting face, when the arm piece is deformed outward of the frame body, a part of the second face of the arm piece is in contact with the butting face.

Each of the slits may have a step-like shape in a direction of thickness of the side wall.

The slits may be provided from an open end of the frame body.

One of the slits may be formed between the second face of the arm piece and the butting face.

The butting face may be formed at a distance from the arm piece by one of the slits.

According to an aspect of the invention, even though the terminal metal fitting is spread by the base part which is inserted into the frame body, and the arm piece is deformed outward, the back face of the arm piece comes into contact with the butting face, when the arm piece is deformed up to a predetermined position. In this manner, it is possible to prevent the terminal metal fitting and the arm piece from being excessively deformed. As the results, permanent deformation of the terminal metal fitting and breakdown of the arm piece due to the excessive deformation can be prevented, and hence, it is possible to restrain deterioration of the holding force of the bulb with respect to the socket.

According to an aspect of the invention, there is no necessity of providing a protuberance or the like on an outer peripheral face of the frame body for the purpose of forming a butting face on the frame body. As the results, the socket can be formed simple in shape, and freeness in designing the socket can be enhanced.

According to an aspect of the invention, it is possible to prevent the excessive deformation of the terminal metal fitting, when the base part of the bulb is inserted into the frame body.

DETAILED DESCRIPTION OF THE EXEMPLARY EMBODIMENTS

Figure 1:
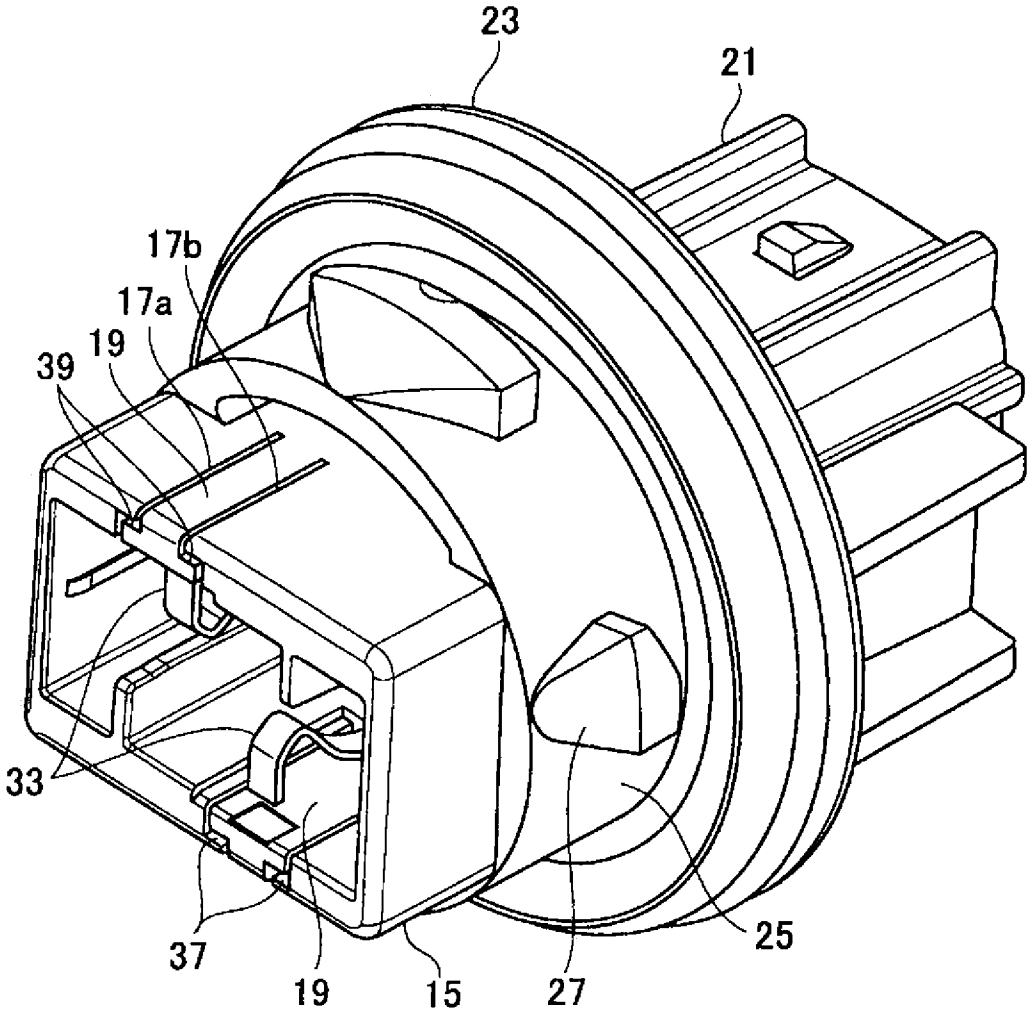
FIG. 1 is a perspective view showing a structure of a socket according to the invention.

Now, an embodiment of a lamp unit employing a socket according to the invention will be described referring to the drawings.

Figure 2:
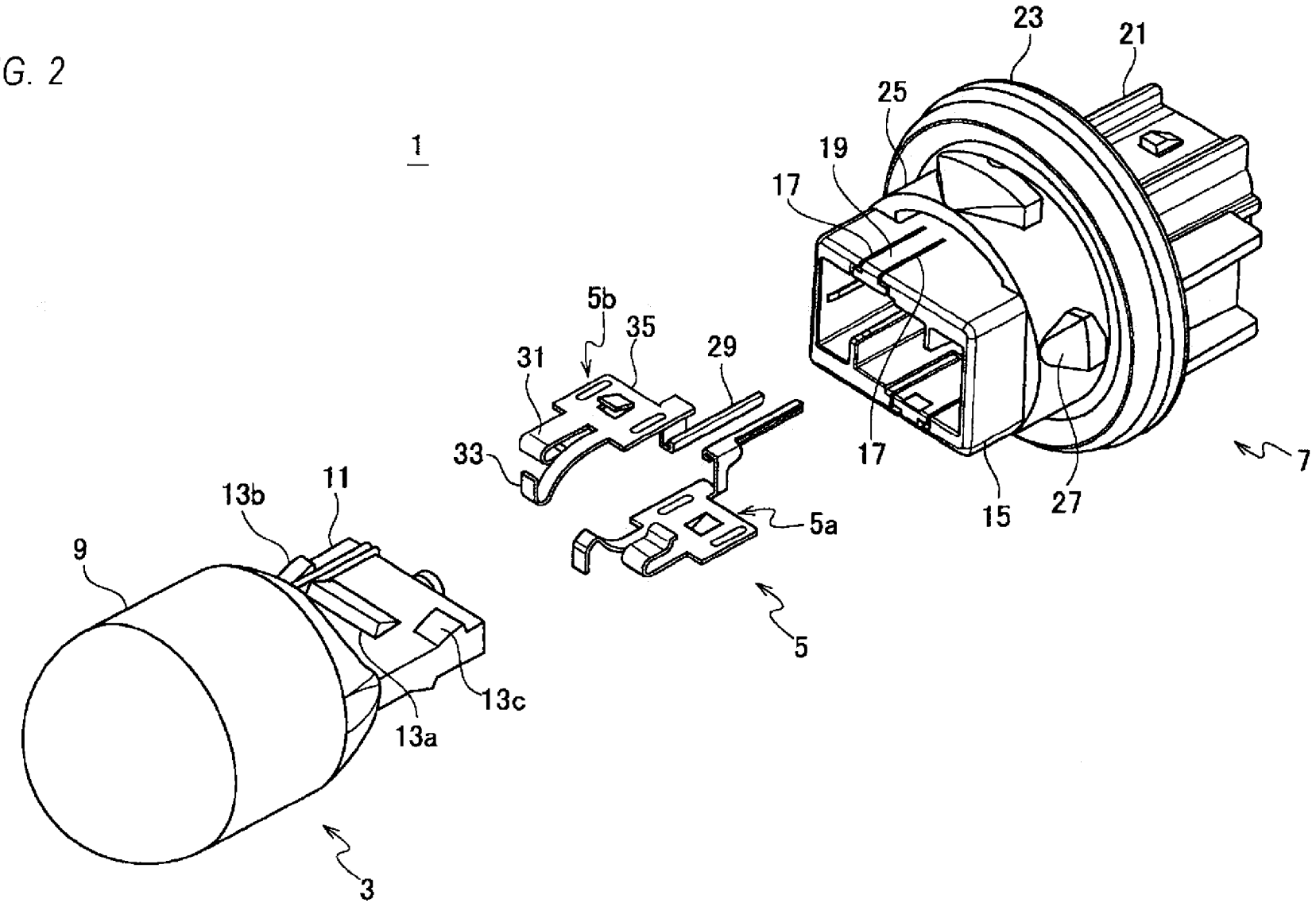
FIG. 2 is an exploded perspective view for describing a state where terminal metal fittings and a lamp bulb is mounted to the socket according to the invention.

As shown in FIG. 2, a lamp unit 1 in this embodiment includes a bulb 3, terminal metal fittings 5*a*, 5*b* formed of metal, and a socket 7 formed of resin to which the bulb 3 is to be mounted. The bulb 3 has an electric lamp 9, and a base part 11 which is formed in a shape of a rectangular plate. Convex parts 13 having inclined faces in a mounting direction to the socket 7, and projecting in a V-shape in section are provided on both faces of the base part 11 opposed to each other. Each of the convex parts 13 includes a first convex part 13*a* which is formed at a substantially center in a lateral direction of the base part 11, a second convex part 13*b* and a third convex part 13*c* which are formed at both sides of the convex part 13*a*.

As shown in FIG. 1, the socket 7 has a frame body 15 which is formed in a rectangular tubular shape in conformity with the base part 11 of the bulb 3 so that the base part 11 may be inserted into this frame body 15. Two side walls of the frame body 15 opposed to each other are respectively provided with pairs of slits 17*a*, 17*a* which are cut out from a distal end (an open end) of the frame body 15 by a predetermined length in an axial direction of the frame body 15, that is, the direction of inserting the base part 11. An arm piece 19 for elastically supporting the terminal metal fitting 5 is formed between each pair of the slits 17*a*, 17*a*.

A connector part 21 into which a female connector can be inserted is provided at a bottom face side of the frame body 15, and a flange 23 is formed between the connector part 21 and the frame body 15. Moreover, a round-shaped body part 25 is provided between the flange 23 and the frame body 15, and a plurality of engaging projections 27 are provided on an outer peripheral face of the body part 25, at a predetermined interval in a circumferential direction. The engaging projections 27 are adapted to be engaged with predetermined fitting holes in cooperation with the flange 23.

Each of the terminal metal fittings 5*a*, 5*b* is formed by folding a plate formed of heat resistant copper alloy, and includes a fitting part 29, an electrode part 31, a movable contact part 33, and a connecting part 35 for connecting these parts. The fitting part 29 is inserted into a through hole (not shown) which is formed in the frame body 15 of the socket 7 thereby to support the terminal metal fitting 5 inside the frame body 15, and at the same time, a distal end of the fitting part 29 is protruded into the connector part 21 at a back side thereby to function as a male terminal. The electrode part 31 is extended from the connecting part 35 up to a position to be opposed to an electrically conductive part (a lead wire, for example) which is exposed from the base part 11 of the bulb 3, and formed by folding its distal end in a U-shape inward into the frame body 15. The movable contact part 33 is extended from the connecting part 35 to an opposite side to the fitting part 29, and formed by folding its distal end outward of the frame body 15.

The terminal metal fittings 5*a*, 5*b* having the above described structure are mounted to an inside of the frame body 15, by inserting the respective fitting parts 29 into the through holes in the frame body 15, and the movable contact parts 33 are positioned so as to be opposed to the corresponding arm pieces 19. On this occasion, the folded distal ends of the movable contact parts 33 are positioned at a predetermined distance from the arm pieces 19.

Now, a structure of the arm piece 19 in this embodiment will be described.

As shown in FIG. 1, the arm piece 19 is formed between the two slits 17*a*, 17*b* which are provided on each of the side walls of the frame body 15 opposed to each other. These two slits 17*a*, 17*b* are provided from the open distal end of the frame body 15 along the axial direction of the frame body 15, and have a predetermined shape in a direction of thickness of the side wall of the frame body 15. Specifically, the slits 17*a*, 17*b* are formed in a step-like shape, in such a manner that a distance between them becomes smaller stepwise in a direction of thickness from an inside to an outside of the side wall of the frame body 15. Accordingly, the arm piece 19 is formed in a step-like shape in such a manner that its size in a lateral direction (a direction perpendicular to the direction of thickness) becomes smaller stepwise in the direction of thickness from the inside to the outside of the frame body 15.

The frame body 15 is provided with a butting face 37 which is formed by cutting out the frame body 15 in the direction of thickness, and the arm piece 19 has a back face 39 to be opposed to the butting face 37, at an opposite side to its face opposed to the terminal metal fitting 5 (the movable contact part 33). By cutting out each of the side walls of the frame body 15 in a step-like shape, the arm piece 19 and the butting face 37 are formed in each of the side walls. The butting face 37 and the back face 39 are arranged so as to be opposed to each other at a predetermined distance by way of the slits 17*a*, 17*b*. As the results, when the arm piece 19 is deformed outward of the frame body 15, a part of the back face 39 of the arm piece 19 comes into contact with the butting face 37.

Figure 3A:
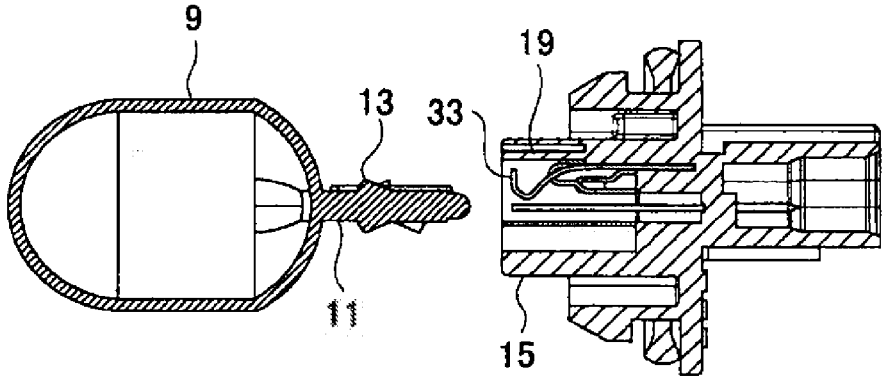
FIGS. 3A, 3B and 3C are views for describing operations for mounting the lamp bulb to the socket according to the invention.

Then, operation when the base part 11 of the bulb 3 is inserted into the frame body 15 will be described referring to FIGS. 3A to 4. It is to be noted that only the terminal metal fitting 5*a* is shown in FIGS. 3A, 3B and 3C, while the terminal metal fitting 5*b* is omitted. FIG. 4 is a view showing a part of FIG. 3C in an enlarged scale.

As shown in FIG. 3A, before the base part 11 of the bulb 3 is inserted into the frame body 15, the distal ends of the movable contact parts 33 of the terminal metal fittings 5 are not in contact with the arm pieces 19.

Figure 3B:
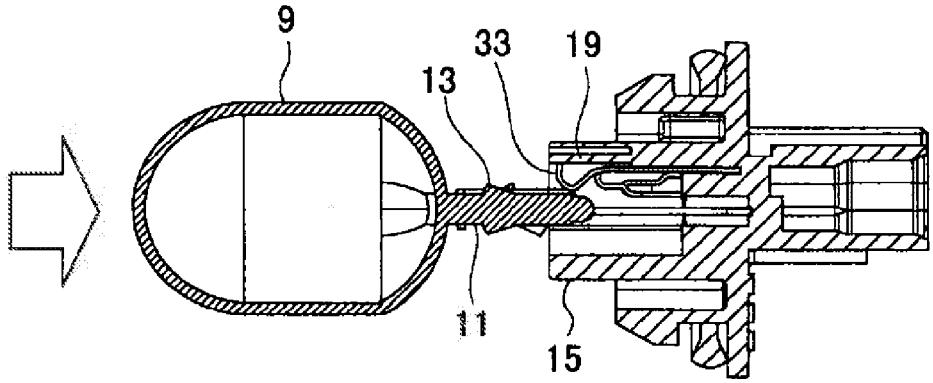
Figure 4:
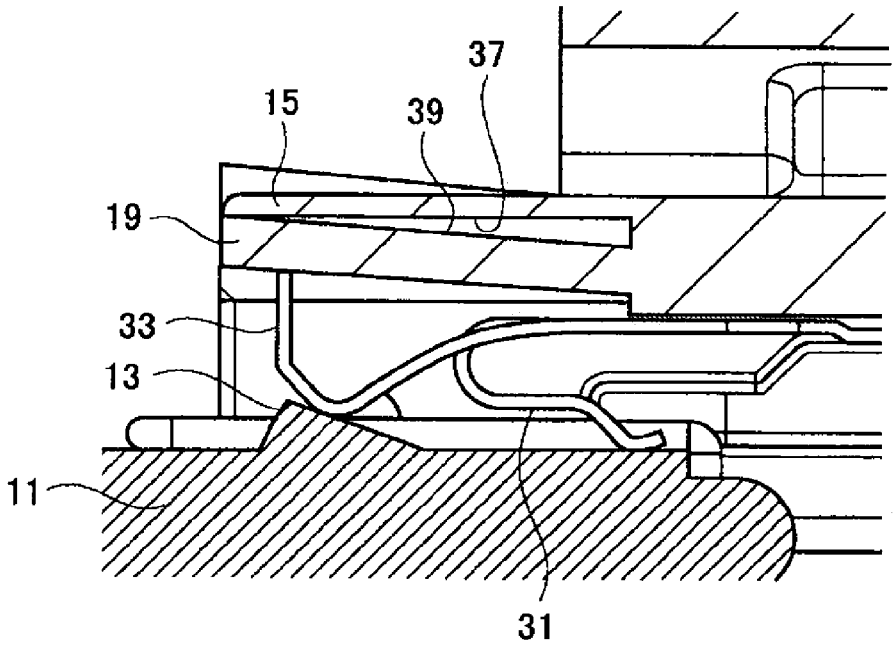
FIG. 4 is a sectional view showing an area surrounding the terminal metal fitting in FIG. 3C in an enlarged scale.

Then, as shown in FIG. 3B, as the base part 11 of the bulb 3 is inserted into the frame body 15, the base part 11 intrudes between a pair of the movable contact parts 33, and the movable contact parts 33 are spread outward of the frame body 15. The distal ends of the movable contact parts 33 come into contact with the arm pieces 19 thereby to be supported by the arm pieces 19.

Figure 3C:
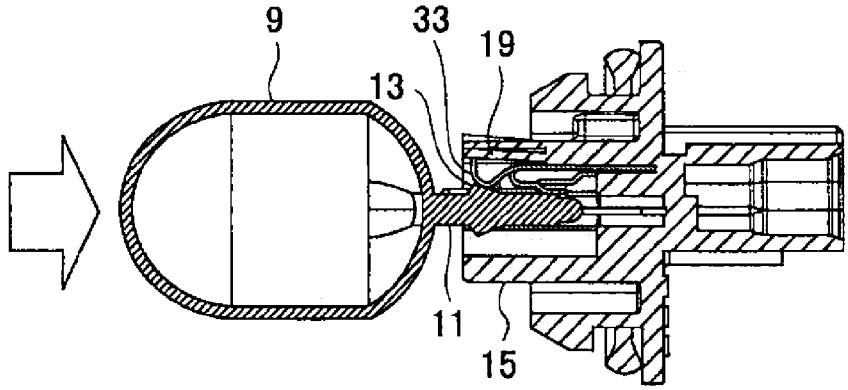

Then, as shown in FIG. 3C, when the base part 11 is deeply inserted, the distal ends of the movable contact parts 33 push the arm pieces 19 to spread them outward for the purpose of further spreading the movable contact parts 33 outward by the convex parts 13 of the base part 11 (FIG. 4). In this manner, in both inserting operation and withdrawing operation, spring forces by means of the movable contact parts 33 and the arm pieces 19 are applied to the base part 11 as pressurizing forces.

Figure 5:
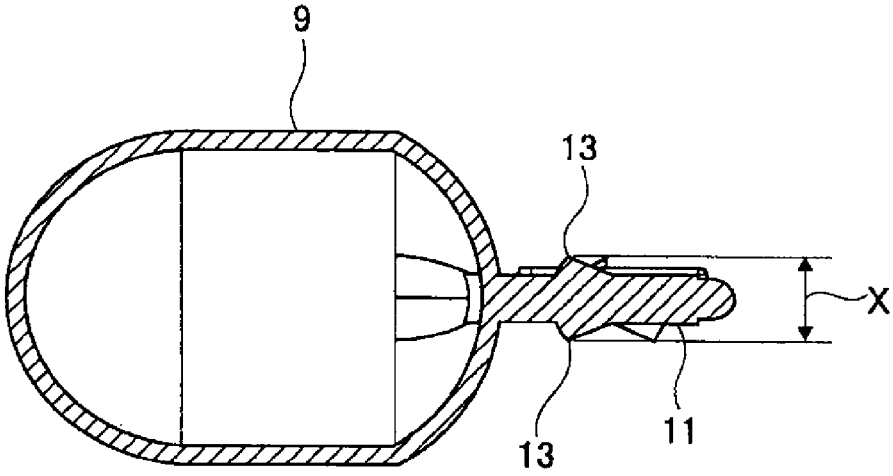
FIG. 5 is a view for describing predetermined sizes and positions in the bulb.

On this occasion, as shown in FIG. 5, a distance X between respective apexes of the convex parts 13 which are formed on the both faces of the base part 11 is set to have a larger tolerance range as compared with a tolerance in size of the socket 7, for example. For this reason, in case where the terminal metal fitting 5 and the socket 7 are so formed as to satisfy the prescription of the holding force (resistivity in the withdrawing direction) of the base part 11 when X is at the lower limit value of the tolerance, the movable contact part 33 of the terminal metal fitting 5 is largely pushed outward together with the arm piece 19, when the base part 11 in which X is at the upper limit value of the tolerance is inserted into the frame body 15. On this occasion, in case where an amount of the deformation of the movable contact part 33 is more than a predetermined value, there is such anxiety that permanent deformation of the movable contact part 33 may occur, and consequently, the holding force of the base part 11 may not satisfy the prescription.

In this respect, according to the embodiment, when the arm piece 19 is pressed against the movable contact part 33 and deformed outward of the frame body 15 by a predetermined amount, as shown in FIG. 3C, the back face 39 of the arm piece 19 comes into contact with the butting face 37 of the frame body 15, and further deformation can be prevented. Because the movable contact part 33 and the arm piece 19 are restrained from being deformed outward of the frame body 15 in this manner, it is possible to prevent the permanent deformation of the movable contact part 33 due to an excessive deformation. It is also possible to prevent the arm piece 19 from being broken due to the excessive deformation. As the results, it is possible to restrain decrease of the holding force of the base part 11, and deterioration of the electric contact performance between the bulb 3 and the terminal metal fitting 5.

A distance between the back face 39 of the arm piece 19 and the butting face 37 of the frame body 15 can be appropriately determined considering relations among, for example, the amount of deformation of the movable contact part 33, presence or absence of the permanent deformation of the terminal metal fitting 5 including the movable contact part 33, and the prescribed value of the holding force of the base part 11. The distance can be set in such a manner that the back face 39 of the arm piece 19 may be butted against the butting face 37 of the frame body 15, at least before the permanent deformation of the movable contact part 33 occurs.

According to the structure of the socket 7 in this embodiment, it is possible to retrain the deformation of the arm piece 19 in addition to the deformation of the movable contact part 33. Therefore, even in case where the base part 11 of the bulb 3 is inserted diagonally with respect to an axis of the frame body 15, or even in case where the base part 11 comes into contact with the arm piece 19, the arm piece 19 will not be broken because of the excessive deformation. As the results, it is possible to prevent breakdown of the arm piece 19 when the bulb 3 is inserted, and workability can be enhanced.

Although the embodiment according to the invention has been heretofore described referring to the drawings, the embodiment shows the invention only by way of example, and the invention is not limited to the structure in the embodiment. It is apparent that the invention includes any modification in design within a scope not deviating from a gist of the invention.

For example, in this embodiment, the slits 17*a*, 17*b* are formed in a step-like shape in the direction of the thickness of the frame body 15, and the back face 39 of the arm piece 19 and the butting face 37 of the frame body 15 are arranged inside the frame body 15. However, it is also possible to arrange the back face of the arm piece 19 in flush with the outer peripheral face of the frame body 15. In this case, a protuberance may be formed so as to project from the outer peripheral face of the frame body 15 in a manner surrounding this back face, and a butting face may be provided inside the protuberance.

This embodiment can be applied mainly to a socket of a bulb which is mounted on a mobile unit such as an automobile, but not limited to this. It is also possible to apply the embodiment to structures for holding various types of bulbs.

What is claimed is:

1. A socket comprising:

a tubular frame body into which a base part of an electric lamp bulb is to be inserted, the frame body in which a terminal metal fitting to be electrically connected with the base part is to be provided, the frame body having a side wall formed with two slits and formed with an arm piece between the slits, the arm piece which has a first face to be opposed to the terminal metal fitting and a second face opposite to the first face, the side wall formed with a butting face, when the arm piece is deformed outward of the frame body, a part of the second face of the arm piece is in contact with the butting face.

2. The socket according to claim 1, wherein each of the slits has a step-like shape in a direction of thickness of the side wall.

3. The socket according to claim 1, wherein the slits are provided from an open end of the frame body.

4. The socket according to claim 1, wherein one of the slits is formed between the second face of the arm piece and the butting face.

5. The socket according to claim 1, wherein the butting face is formed at a distance from the arm piece by one of the slits.

* * * * *